US005573139A

United States Patent [19]

Yeh

[11] Patent Number: 5,573,139

[45] Date of Patent: Nov. 12, 1996

[54] DRINKING MUG WITH LID AND MUG BODY FORMED FROM ONE PIECE

[76] Inventor: Frank Yeh, 1019 N. Mayflower St., Anaheim, Calif. 92801

[21] Appl. No.: 498,150

[22] Filed: Jul. 5, 1995

[51] Int. Cl.[6] ..... B65D 51/16

[52] U.S. Cl. ..... 220/360; 215/DIG. 7; 215/310; 215/387; 215/396; 220/361; 220/254; 220/710.5; 220/713; 220/212.5

[58] Field of Search ..... 220/703, 307, 220/704, 710, 710.5, 711, 713, 719, 716, 360, 361, 352, 356, 254, 212; 215/DIG. 7, 902, 307, 378, 387, 396, 354, 228, 263, 309, 310, 341, 371

[56] References Cited

U.S. PATENT DOCUMENTS

| | | | |
|---|---|---|---|
| 2,921,708 | 1/1960 | Marcel | 215/230 |
| 3,237,802 | 3/1966 | Wagner | 220/254 X |
| 3,372,832 | 3/1968 | Yeater et al. | 220/254 |
| 3,635,380 | 1/1972 | Fitzgerald | 220/715 X |
| 3,739,938 | 6/1973 | Paz | 220/715 |
| 4,133,446 | 1/1979 | Albert | 220/715 |
| 4,582,218 | 4/1986 | Ross . | |
| 4,586,622 | 5/1986 | Walldorf | 220/254 X |
| 4,595,437 | 6/1986 | Yamamoto | 220/421 X |
| 4,658,979 | 4/1987 | Mietz et al. | 220/203.13 |
| 4,850,501 | 7/1989 | Shield | 220/704 |
| 4,998,633 | 3/1991 | Schneider | 220/203.14 X |
| 5,018,636 | 5/1991 | Ross | 220/719 |
| 5,102,000 | 4/1992 | Feltman, III . | |
| 5,143,248 | 9/1992 | Sawatsky | 220/711 |
| 5,217,141 | 6/1993 | Ross | 220/307 X |
| 5,249,703 | 10/1993 | Karp | 220/719 |
| 5,284,271 | 2/1994 | Ross | 220/703 X |
| 5,307,950 | 5/1994 | Li | 220/714 |
| 5,372,275 | 12/1994 | Yeh | 220/307 X |
| 5,454,482 | 10/1995 | Simon | 220/718 |

FOREIGN PATENT DOCUMENTS 1029516 6/1953 France .

*Primary Examiner*—Gary E. Elkins
*Assistant Examiner*—Robin A. Hylton
*Attorney, Agent, or Firm*—Raymond Sun

[57] ABSTRACT

A drinking mug includes a mug body having an outer wall, an inner wall and a mouth defined by an upper edge. The mug includes a lid provided integral with the inner wall and substantially covering the mouth, the lid having an outer edge, a first opening and a second opening. The first and second openings are adapted to pass liquid and other substances therethrough, with the first opening provided along the outer edge of the lid for drinking purposes. A third opening is provided along the outer edge of the lid substantially opposite the first opening. A cover is provided for covering the second opening.

17 Claims, 3 Drawing Sheets

DRINKING MUG WITH LID AND MUG BODY FORMED FROM ONE PIECE

BACKGROUND OF THE INVENTION

1. Field of the Invention

The present invention relates to a drinking mug, and in particular, to a drinking mug that has a lid provided integrally therewith. The drinking mug with an integral lid minimizes the possibility of spillage of the liquid contained therein, and is useful in maintaining the liquid at the desired temperature.

2. Description of the Related Art

The present invention is applicable to mugs and beverage containers alike, which shall hereinafter be collectively referred to as "mugs". These mugs are typically made of ceramic material because ceramic is easy to clean, does not carry any unpleasant odors, and is effective in maintaining the temperature of the liquid contained therein. However, ceramics are not the only materials that can be used, and other materials such as porcelain, glass, plastics and stoneware, for example, may also be used for making beverage containers and mugs according to the present invention.

Many of the mugs that are presently available today are used to hold hot beverages such as coffee, tea or hot water, for example. However, these mugs cannot be conveniently carried to different locations, such as in an automobile, because the liquid contents are easily spillable from the open mouth of the mug. Even if easily transportable, the liquid contained in these mugs quickly lose their temperature because the mouth of the mugs are open.

In response to these problems, attempts have been made to provide safety lids that may be used to cover the open mouth of mugs. These safety lids perform two primary functions: (1) to cover the open mouth of the mug to prevent the liquid contained in the mug from spilling, and (2) to maintain the temperature of hot liquid in the mug by preventing the escape of steam.

For example, a number of mug and lid combinations were provided in which a specific lid is adapted for use with a specific mug, each having a predetermined size and configuration. Examples of such mug and lid combinations are illustrated in U.S. Pat. Nos. 4,582,218 (Ross), 5,018,636 (Ross), 5,102,000 (Feltman, III), 5,217,141 (Ross) and 5,249,703 (Karp). Most of these lids are made of plastic. However, these mug and lid combinations suffer from several drawbacks. First, each of these mugs must be used with its intended lid. Thus, a user must purchase both the mug and the lid, which may be undesirable because the combination will cost more than just a lid alone, and the user may have no need for the additional mug. Another drawback experienced by the above-mentioned mug and lid combinations is that they typically require precise interaction between the various elements of the mug and the lid. Since the nature of ceramic makes it difficult to manufacture ceramic mugs to meet precise sizes and shapes, the user may therefore find the lids difficult to use with a ceramic mug. Additionally, some of the lids contain fragile elements that may affect the durability of the lid. For example, the Ross '636, Feltman III and Karp patents describe the use of plastic rods, fingers or arms that are easily breakable after extended or rough use. This increases the cost to the user who must then replace the defective lids, or be left with a mug that cannot be used with a different lid.

Another type of safety lid is adapted to be used with any conventional mugs having certain standard mouth sizes, so that these lids can be sold as separate components. An example is illustrated in U.S. Pat. No. 5,368,186 (Yeh). However, these lids require the user to purchase an extra component for use, and are not effective with non-conventional mugs.

In addition, many of the above-mentioned safety lids still suffer from the drawback that they are not securely retained at the mouth of the mug, which allows spillage of the liquid if the mug is tipped over. These lids also make it inconvenient for a user to drink from the mug, since an insecure lid usually means that the user must hold the lid while drinking. Another potential drawback is associated with the use of mugs by children. Parents are often concerned that children will be scalded by hot liquids spilled from a cup or mug. Also, children tend to be less careful and are less likely to have the patience and/or care to properly deploy a safety lid with a mug of hot liquid. Thus, parents are less likely to allow children to use mugs with open mouths, or even mugs with deployable safety lids.

Thus, there is a need for a drinking mug that is safe and easy to use, can be provided at low cost, and which effectively prevents spillage of the liquid contained therein so that it may even be used effectively by children or a careless adult.

SUMMARY OF THE INVENTION

The objects of the present invention may be achieved by providing a drinking mug comprising a mug body having an outer wall, an inner wall, an upper edge and a mouth defined by the upper edge. The mug includes a lid provided integral with the inner wall and substantially covering the mouth, the lid comprising an outer edge, a first opening and a second opening. The first and second openings are adapted to pass liquid and other substances therethrough, with the first opening provided along the outer edge of the lid for drinking purposes. A third opening is provided along the outer edge of the lid substantially opposite the first opening.

The mug according to the present invention further comprises a cover for covering the second opening. The cover comprises a top plate connected to a bottom plate, the bottom plate having a diameter that is slightly larger than the diameter of the second opening. The bottom plate is made from a flexible material and is adapted to be flexed to allow the bottom plate to pass through the second opening. The top plate completely covers the second opening when the cover is deployed at the second opening. The bottom plate comprises an upper surface, with a portion of the upper surface of the bottom plate engaging the lower surface of the lid when the cover is deployed at the second opening to keep the cover secured at the second opening.

The cover according to a first preferred embodiment comprises a conical wall connected between the top and bottom plates, the conical wall having a larger diameter adjacent the top plate and a smaller diameter adjacent the bottom plate. The conical wall adjacent the top plate has a diameter that is substantially the same as the diameter of the second opening and is adapted to engage the second opening thereat.

The cover according to a second preferred embodiment comprises a knob connected to a shaft, the knob and shaft connecting the top and bottom plates.

The cover according to a third preferred embodiment comprises a top plate and a core attached to the bottom surface of the top plate. The core has a diameter that is slightly larger than the diameter of the second opening, and the core is adapted to be inserted into the second opening. The cover according to the third preferred embodiment further comprises a sealing material attached to the outer surface of the core, the sealing material having an outer surface that is adapted to frictionally engage the annular edge of the second opening to secure the core to the second opening.

Thus, the mug according to the present invention is effective in preventing the liquid contained therein from spilling because its integral lid essentially blocks a substantial portion of the mouth of the mug. The sizes of the openings are designed to be as small as possible to minimize any spillage that may occur therethrough, and the covers according to the present invention are also effective in sealing the second opening. Further, the mug of the present invention is effective in maintaining the temperature of the liquid contained therein because the sizes of the openings are designed to be as small as possible to minimize any escape of steam therethrough. The mug has a simple design and construction, and is also easy to manufacture and easy to use. Therefore, the mug can be conveniently and safely used by children.

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
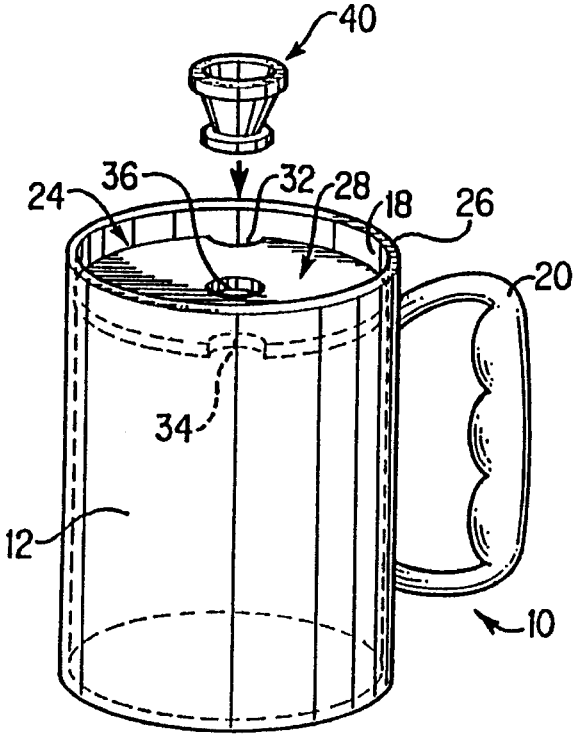
FIG. 1 is a exploded perspective view of a drinking mug and a cover in accordance with an exemplary embodiment of the present invention.
Figure 2:
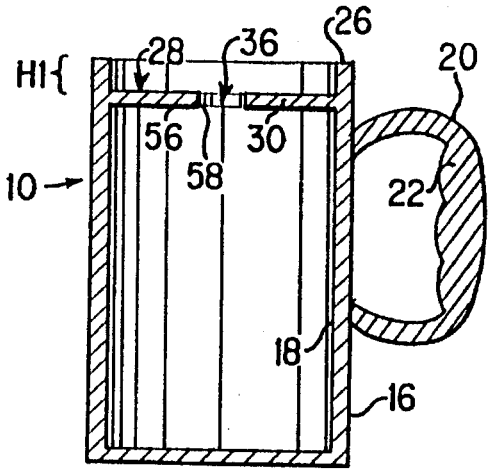
FIG. 2 is a cross-sectional view of the mug of FIG. 1.
Figure 3:
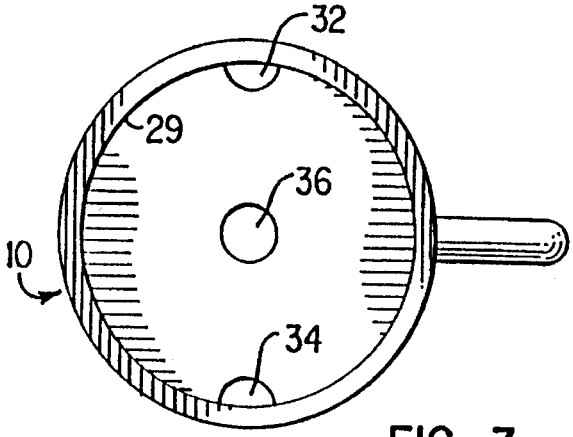
FIG. 3 is a top plan view of the lid of FIG. 1.

The drinking mug 10 in accordance with a first preferred embodiment of the present invention is shown in FIGS. 1–3. The mug 10 comprises a substantially cylindrical mug body 12 having a base 14, an outer wall 16 and an inner wall 18. A curved handle 20 is provided along the outer wall 16, and comprises three bumps or curved segments 22 which are adapted to assist the user in gripping the handle 20. The handle 20 may assume any configuration without departing from the spirit and scope of the present invention.

The mug 10 further comprises a mouth 24 defined by its upper circumferential edge 26. A lid 28 is provided inside the mouth 24 slightly offset from the upper edge 26. Specifically, the lid 28 comprises a flat lid portion 30 that is provided integrally with the inner wall 18 at a height H1 from the upper edge 26. The height H1 ranges from 0.2 inches to 1.0 inch, and is preferably about 0.5 inches. The lid 28 substantially covers the mouth 24 of the mug 10 except for three openings, two opposing drinking openings 32 and 34 and a central opening 36. The drinking openings 32 and 34 are formed in a substantially semi-circular shape and are provided along the outer edge 29 of the lid 28 to allow the liquid contained in the mug 10 to flow therethrough for drinking purposes. The drinking openings 32 and 34 are preferably provided in opposing fashion about ninety degrees from the handle 20 (see FIG. 3) so that the opening 34 can be used when the handle 20 is gripped with the user's right hand, and the opening 32 can be used when the handle 20 is gripped with the user's left hand. The central opening 36 allows for the introduction of liquid (such as water, coffee, tea, alcohol, for example), sugar, cream, milk and/or other substances. Thus, each of the openings 32, 34 and 36 should have a size that is large enough to facilitate the passage of liquids and substances, but yet is as small as possible to minimize spillage and to minimize the escape of steam therefrom. With these considerations, the radius of each drinking opening 32 and 34 ranges from 1/64 to 0.25 inches, and is preferably about 1/16 inches, and the diameter of the central opening 36 ranges from 0.25 to 2.0 inches, and is preferably about 0.5 inches.

The mug body 12 and the lid 28 are preferably molded integrally or provided in one piece from the same material. Alternatively, the lid 28 may be provided separately and then connected to the inner wall 18 of the mug body 12 along the outer edge 29. In any case, the term "integral lid" as used herein means a lid that is either provided integrally with or permanently connected to the inner wall 18. The body 12 and the lid 28 may be made from any non-toxic material such as ceramics, plastic, glass, porcelain or stainless steel, but are preferably made from ceramics. The mug body 12 has a thickness ranging from 1/32 to 1/8 inches, and is preferably about 1/16 inches. Similarly, the lid portion 30 has a thickness ranging from 1/64 to 1/8 inches, and is preferably about 1/16 inches.

The mug 10 of the present invention is effective in preventing the liquid contained therein from spilling because the lid 28 essentially blocks a substantial portion of the mouth 24. The sizes of the openings 32, 34 and 36 are designed to be as small as possible to minimize any spillage that may occur therethrough. Further, the mug 10 of the present invention is effective in maintaining the temperature of the liquid contained therein because the sizes of the openings 32, 34 and 36 are designed to be as small as possible to minimize any escape of steam therethrough.

Figure 4:
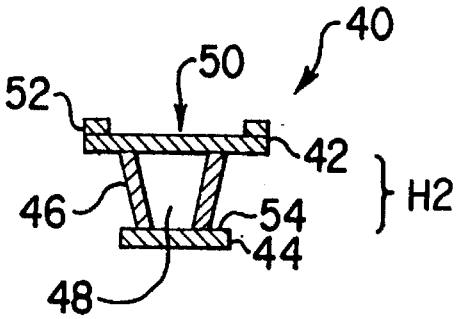
FIG. 4 is a cross-sectional view of the cover illustrated in FIG. 1.
Figure 5:
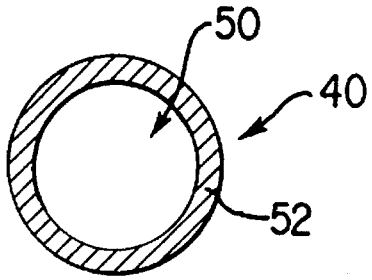
FIG. 5 is a top plan view of the cover illustrated in FIG. 1.

The central opening 36 may be closed by a cover. Referring to FIGS. 1, 4 and 5, the cover 40 according to a first preferred embodiment comprises a top plate 42 and a bottom plate 44 connected by a substantially conical wall 46. The space 48 that is between the plates 42 and 44 and the conical wall 46 may be hollow, or may be filled with a soft material. The top plate 42 is provided with a recessed region 50 defined by an annular flange 52. The cover 40 is preferably made from a soft and flexible material that has been approved by the Food and Drug Administration, such as but not limited to rubber, silicone, polyethylene or PVC. The cover 40 may be provided in one integral piece, or may be made by connecting separate top and bottom plates 42, 44 to the conical wall 46.

The diameter of the bottom plate 44 is preferably slightly larger than the diameter of the opening 36 to allow the cover 40 to be secured to the opening 36. In use, the cover 40 is pushed downwardly through the opening 36 to deploy it at the opening 36. Since the cover 40 is made from a soft and flexible material, its bottom plate 44 is flexed upwardly when the cover 40 is pushed through the opening 36 so that the bottom plate 44 can pass through the opening 36. When deployed in this manner, the top plate 42 completely covers the opening 36, and since the bottom plate 44 has a diameter that is slightly larger than the diameter of the opening 36, a portion of its upper surface 54 near its outer edge engages the bottom surface 56 of the lid 28 to prevent the cover 40 from becoming disengaged from the opening 36 if the mug 10 is tilted or even overturned. To remove the cover 40 from the opening 36, the user simply grips the annular flange 52 and the circumferential edge of the top plate 42, and lifts the cover 40. The flexible bottom plate 44 flexes downwardly to allow it to be pulled through the opening 36.

The diameter of the top plate 42 is preferably larger than that of the opening 36 so as to completely cover the opening 36. The conical wall 46 tapers downwardly so that its diameter is largest adjacent the top plate 42 and smallest adjacent the bottom plate 44. The diameter of the conical wall 46 adjacent or near the top plate 42 is preferably about the same diameter as the opening 36 so that the conical wall 46 engages the annular edge 58 of the opening 36 adjacent the top plate 42. This allows the cover 40, and in particular, the top plate 42, to be securely engaged at the opening 36 and to completely cover the opening 36 so that the cover 40 does not slide around when the mug 10 is being moved around. The height H2 of the conical wall 46, or the distance between the plates 42 and 44, ranges from 1/64 to 1/8 inches, and is preferably about 1/16 inches. Although the wall 46 is described as being substantially conical, it will be appreciated by those skilled in the art that substantially cylindrical walls, or walls having other configurations, can be used without departing from the spirit and scope of the present invention.

Figure 6:
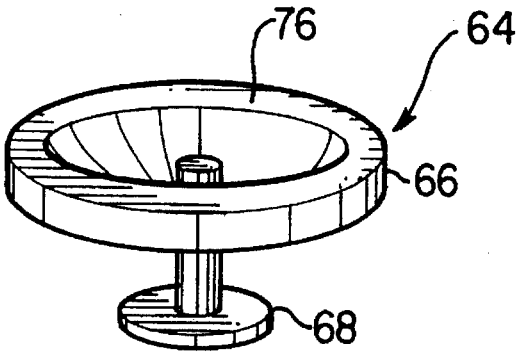
FIG. 6 is a perspective view of a cover according to a second embodiment of the present invention that may be adapted for use with the mug of FIG. 1.
Figure 8:
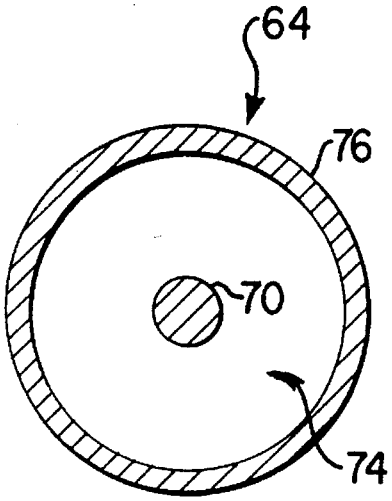
FIG. 8 is a top plan view of the cover of FIG. 6.
Figure 7:
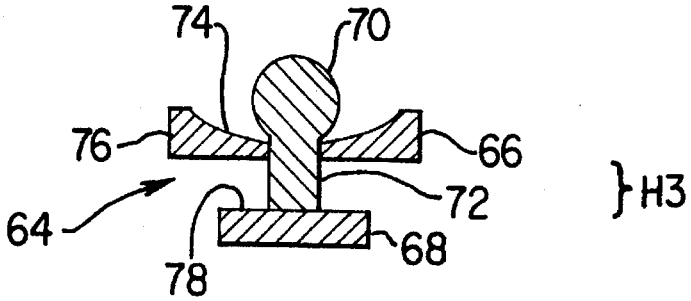
FIG. 7 is a cross-sectional view of the cover of FIG. 6.

FIGS. 6–8 illustrate a cover 64 according to a second preferred embodiment that can also be used with the mug 10. The cover 64 comprises a top concave plate 66 and a bottom plate 68 that are connected by a knob 70 and its shaft 72. The bottom plate 68 is similar to the bottom plate 44 of cover 40, and is also preferably slightly larger in diameter than the diameter of the opening 36. The top plate 66 is substantially bowl-shaped and has a concave interior 74 defined by an annular outer wall 76. The top plate 66 has a diameter which is preferably larger than that of the opening 36 so as to completely cover the opening 36. The shaft 72 has one end connected to the central portion of the bottom plate 68 and extends through the top plate 66 with its knob 70 disposed within the concavity 74. The height H3 of the shaft 72, or the distance between the plates 66 and 68, ranges from 1/64 to 1/8 inches, and is preferably about 1/16 inches.

The cover 64 may be provided integrally, or may be provided in three separate components (the top plate 66, the bottom plate 68 and the combined shaft 72 and knob 70) which are then connected. The cover 64 is preferably made from the same type of material described above for the cover 40. The cover 64 is also operated using similar principles as for cover 40. Specifically, to deploy the cover 64, the user grips the knob 70 and pushes the cover 64 downwardly against the opening 36 so that the bottom plate 68 is flexed upwardly and pushed through the opening 36. When in use, the top plate 66 completely covers the opening 36, and a portion of the upper surface 78 of the bottom plate 68 engages the bottom surface 56 of the lid 28 to prevent the cover 64 from becoming disengaged from the opening 36. To remove the cover 64 from the opening 36, the user merely grips the knob 70 and lifts the cover 64, causing the bottom plate 68 to be flexed downwardly to be pulled from the opening 36.

Figure 10:
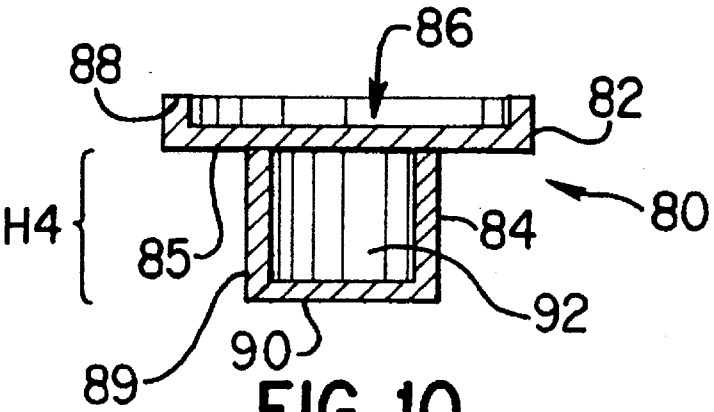
FIG. 10 is a cross-sectional view of the cover of FIG. 9.
Figure 9:
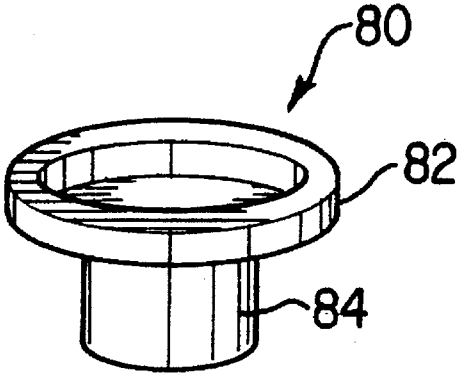
FIG. 9 is a perspective view of a cover according to a third embodiment of the present invention that may be adapted for use with the mug of FIG. 1.

FIGS. 9–10 illustrate a cover 80 according to a third preferred embodiment that can also be used with the mug 10. The cover 80 comprises a top plate 82 that is similar to the top plate 42 of cover 40. The cover 80 further comprises a substantially cylindrical core 84 provided integrally with or attached to the bottom surface 85 of the top plate 82. The top plate 82 further includes a recessed region 86 defined by an annular flange 88. The core 84 is defined by a substantially cylindrical wall 89 and a bottom wall 90, and defines a hollow space 92 therewithin. As with the other covers 40 and 64, the top plate 82 has a diameter which is preferably larger than that of the opening 36 so as to completely cover the opening 36. The diameter of the cylindrical wall 89 is preferably slightly larger than the diameter of the opening 36. The height H4 of the core 84 ranges from 1/64 to 1/8 inches, and is preferably about 1/16 inches. The cover 80 is preferably made from the same type of material described above for the cover 40.

To use the cover 80, the user pushes the cover 40, and in particular, the core 84, into the opening 36. Since the core 84 is made from a soft and flexible material and its diameter is slightly larger than the diameter of the opening 36, the core 84 will be flexed to allow it to plug or block the opening 36 and yet be firmly retained in the opening 36. By plugging the opening 36, the core 84 prevents the escape of steam and is effective in preventing spillage. To remove the cover 80, the user simply grips the annular flange 88 and the circumferential edge of the top plate 82, and lifts the cover 80.

Figure 12:
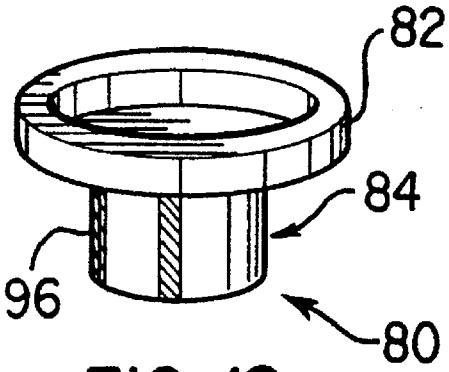
FIG. 12 is a perspective view of the cover of FIG. 9 illustrating a modification made thereto.
Figure 11:
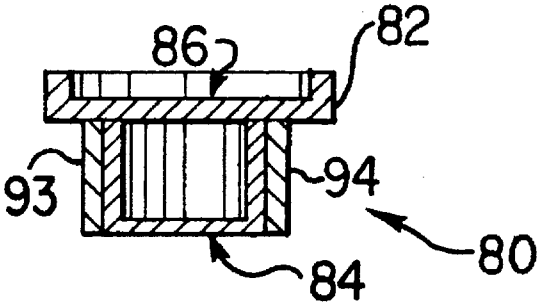
FIG. 11 is a cross-sectional view of the cover of FIG. 9 illustrating a modification made thereto.

FIG. 11 illustrates the cover 80 with an annular sealing ring 93 provided about the outer surface of the cylindrical wall 89 of the core 84. The material of the sealing ring 93 has a resiliency which holds the sealing ring 93 tightly against the cylindrical wall 89 of the core 84. The sealing ring 89 may be attached to the outer surface of the wall 89 by a non-toxic adhesive, or by other conventional attachment methods. Alternatively, the sealing ring 93 may be attached to the wall 89 by fitting it into a groove (not shown) provided in the wall 89, so that its resiliency holds it in the groove and firmly against the wall 89. An outer surface 94 of the sealing ring 93 is adapted to frictionally engage the annular edge 58 of the opening 36 to be firmly secured thereat. The sealing ring 93 is preferably made from a resilient and flexible non-toxic material such as but not limited to rubber, silicon, or polyethylene. Alternatively, referring to FIG. 12, instead of the sealing ring 93, a plurality of strips 96 of sealing material made from the same material as the sealing ring 93 may be attached in spaced-apart manner around the outer surface of the wall 89 by a non-toxic adhesive. The number of strips 96 used and their sizes can be varied as desired as long as sufficient frictional engagement is imparted to engage the opening 36.

Thus, when a cover 40, 64 or 80 has been secured at the opening 36, spillage can be minimized even if the mug 10 is completely overturned. This is because the liquid contained therein can only escape through the openings 32 and/or 34, and the user will typically be able to quickly revert the mug 10 to its normal upstanding position before more spillage occurs. Therefore, the mug 10 is effective for use by children, so that parents can fill the mug 10 with liquid, deploy the cover at the opening 36, and then hand the mug 10 to the child so that the child itself does not need to deploy the cover.

Although the present invention has been described in connection with the preferred embodiments, it will be appreciated by those skilled in the art that modifications can be made and alternatives utilized without departing from the spirit and scope of the present invention. For example, any cover other than those described above can be used as long as they are configured to cover the opening 36 in a secure and reliable manner.

Further, although the openings 32, 34 and 36 are shown in the mug 10 as having certain shapes and sizes, and being provided at certain locations, it will be appreciated by those skilled in the art that the number, the locations, the sizes and the shapes of these openings 32, 34 and 36 can be varied without departing from the spirit and scope of the present invention. For example, the opening 36 can assume any size and shape as long as the opening 36 has a shape and size that facilitates the use of the covers 40, 64 and 80 described above, or any other applicable cover. In addition, the central opening 36 does not necessarily need to be provided at about the central portion of the lid 28, and can be located almost anywhere on the lid 28. In fact, the central opening 36 can also be omitted, with liquid, sugar, cream, milk and/or other substances being introduced through one of the other openings 32 or 34. As a further example, one of the drinking openings 32 or 34 may be omitted, or more than two such openings may be provided.

Moreover, the configuration and size of the mug 10 is not critical, as long as they are provided with an integral lid 28.

Therefore, the mug 10 of the present invention provides an integral lid which is effective in preventing spillage of liquid contained therein. Because of its simple design and construction, the mug 10 is also easy to manufacture and easy to use. Further, the materials used to fabricate the mug 10 and its accompanying cover are inexpensive, so that the mug 10 and cover can be provided at low cost to the public. Furthermore, the mug 10 is safe and convenient for use by children.

While the description above refers to particular embodiments of the present invention, it will be understood that many modifications may be made without departing from the spirit thereof.

What is claimed is:

1. A drinking mug, comprising:

a mug body comprising a side wall and a bottom wall unitarily formed as one piece so that the material of the side wall and the bottom wall merge into each other, the side wall having an outer wall, an inner wall, an upper rim and a mouth defined by the upper rim; and a lid comprising a substantially flat panel formed unitarily in one piece with said side wall so that the material of the lid and the side wall merge into each other and extending radially inwardly from the side wall, the flat panel recessed axially inwardly from the upper rim and covering the mouth of the mug body, the flat panel comprising an outer periphery and a first opening provided along the outer periphery of the flat panel adjacent the side wall.

2. The mug of claim 1, wherein the flat panel comprises a second opening, and wherein the mug further comprises a cover for covering the second opening.

3. The mug of claim 2, wherein the cover comprises a top plate, a bottom plate, and a conical wall connecting the top plate and the bottom plate, the bottom plate having a diameter that is slightly larger than the diameter of the second opening, the bottom plate made from a flexible material to allow the bottom plate to pass through the second opening.

4. The mug of claim 3, wherein the top plate completely covers the second opening when the cover is deployed within the second opening.

5. The mug of claim 4, wherein the bottom plate comprises an upper surface and the flat panel further comprises a lower surface, wherein a portion of the upper surface of the bottom plate engages the lower surface of the flat panel when the cover is deployed at the second opening.

6. The mug of claim 2, wherein the cover comprises a top concave plate, a bottom plate, and a shaft connecting the top concave plate and the bottom plate.

7. The mug of claim 3, wherein the conical wall has a larger diameter adjacent the top plate and a smaller diameter adjacent the bottom plate, the conical wall adjacent the top plate having a diameter that is substantially the same as the diameter of the second opening to engage the second opening thereat.

8. The mug of claim 2, wherein the cover comprises a top plate having a bottom surface, and a core attached to the bottom surface of the top plate, the core having a diameter that is slightly larger than the diameter of the second opening to facilitate a snug fit in the second opening when the core is inserted into the second opening.

9. The mug of claim 8, wherein the core is made from a material selected from the group consisting of rubber, silicone, polyethylene and PVC.

10. The mug of claim 8, wherein the core further comprises an outer surface, the cover further comprising a sealing material attached to the outer surface of the core.

11. The mug of claim 10, wherein the second opening comprises an annular edge, and wherein the sealing material comprises an outer surface that frictionally engages the annular edge of the second opening to secure the core to the second opening.

12. The mug of claim 2, further comprising a third opening provided along the outer periphery of the flat panel substantially opposite the first opening.

13. The mug of claim 2, wherein the diameter of the second opening is less than 2.0 inches.

14. The mug of claim 13, wherein the mug body and the flat panel are made from a material selected from the group consisting of ceramic, porcelain, plastic, and stainless steel.

15. The mug of claim 1, wherein the flat panel is recessed by about 0.5 inches from the upper rim of the mug body.

16. The mug of claim 15, wherein the radius of the first opening is less than 0.25 inches.

17. The mug of claim 1, wherein the thickness of the flat panel ranges from 1/64 to 1/8 inches.

* * * * *